US012012196B2

(12) United States Patent
Sakurada

(10) Patent No.: US 12,012,196 B2
(45) Date of Patent: Jun. 18, 2024

(54) SYSTEM FOR AND METHOD OF CONTROLLING WATERCRAFT

(71) Applicant: YAMAHA HATSUDOKI KABUSHIKI KAISHA, Iwata (JP)

(72) Inventor: Kento Sakurada, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 409 days.

(21) Appl. No.: 17/569,759

(22) Filed: Jan. 6, 2022

(65) Prior Publication Data

US 2022/0266973 A1 Aug. 25, 2022

(30) Foreign Application Priority Data

Feb. 22, 2021 (JP) ..... 2021-026667

(51) Int. Cl.
*B63H 25/42* (2006.01)
*B63H 20/00* (2006.01)
*B63H 20/12* (2006.01)

(52) U.S. Cl.
CPC ..... *B63H 25/42* (2013.01); *B63H 20/12* (2013.01); *B63H 2020/003* (2013.01)

(58) Field of Classification Search
CPC ... B63H 25/42; B63H 20/12; B63H 2020/003
See application file for complete search history.

(56) References Cited

U.S. PATENT DOCUMENTS 8,589,004 B1 * 11/2013 Kanno ..... B63H 25/42 440/4
2006/0240720 A1 * 10/2006 Yamashita ..... B63H 20/12 440/86
2011/0166724 A1 7/2011 Hiramatsu
2013/0096742 A1 * 4/2013 Nose ..... B63H 25/42 701/21

FOREIGN PATENT DOCUMENTS

JP 2011-140272 A 7/2011

* cited by examiner

*Primary Examiner* — Stephen P Avila
(74) *Attorney, Agent, or Firm* — Keating & Bennett, LLP

(57) ABSTRACT

In a swaying mode of a watercraft, a controller sets either of a first shift mechanism and a second shift mechanism to a forward moving state and sets the other of the first and second shift mechanisms to a rearward moving state, while controlling a rudder angle of a first marine propulsion device and a rudder angle of a second marine propulsion device such that a net thrust of a thrust generated by the first marine propulsion device and a thrust generated by the second marine propulsion device is oriented in a sideways direction. When setting the first shift mechanism to the forward moving state and setting the second shift mechanism to the rearward moving state in the swaying mode, the controller switches the second shift mechanism to the rearward moving state and then switches the first shift mechanism to the forward moving state after a delay at the start of the swaying mode.

16 Claims, 12 Drawing Sheets

SYSTEM FOR AND METHOD OF CONTROLLING WATERCRAFT

CROSS REFERENCE TO RELATED APPLICATIONS

This application claims the benefit of priority to Japanese Patent Application No. 2021-026667 filed on Feb. 22, 2021. The entire contents of this application are hereby incorporated herein by reference.

BACKGROUND OF THE INVENTION

1. Field of the Invention

The present invention relates to a system for and a method of controlling a watercraft.

2. Description of the Related Art

There has been conventionally known a type of system for controlling a plurality of marine propulsion devices to move a watercraft in a predetermined operating mode. For example, a system described in Japan Laid-open Patent Application Publication No. 2011-140272 includes a right outboard motor, a left outboard motor, a controller, and a joystick. When the joystick is operated sideways, the controller controls the right and left outboard motors to move the watercraft sideways.

Specifically, when the joystick is operated rightward, the controller switches the left outboard motor to a forward moving state, while switching the right outboard motor to a rearward moving state. Additionally, the controller controls the rudder angle of the right outboard motor and that of the left outboard motor such that a net thrust of a thrust generated by the right outboard motor and that generated by the left outboard motor faces rightward in a corresponding position to the center of gravity of the watercraft. Accordingly, translational movement of the watercraft is made rightward.

In marine propulsion devices, a thrust oriented in a forward moving direction and a thrust oriented in a rearward moving direction exert different transient characteristics with respect to the magnitude of a thrust requested by the controller. The thrust oriented in the forward moving direction reaches the magnitude of the request thrust, and then after a delay, the thrust oriented in the rearward moving direction reaches the magnitude of the request thrust. Because of this, when either of two marine propulsion devices is switched to the forward moving state, and simultaneously, the other is switched to the rearward moving state at a start of a predetermined operating mode, the thrusts generated by the two marine propulsion devices are not in balance and are different in magnitude from each other. Therefore, the watercraft undesirably moves to towards a front side instead of in a straight sideways direction.

SUMMARY OF THE INVENTION

Preferred embodiments of the present invention accurately move a watercraft in a predetermined operating mode.

A system according to a first preferred embodiment of the present invention controls a watercraft. The system includes a first marine propulsion device, a first steering actuator, a second marine propulsion device, a second steering actuator, and a controller. The first marine propulsion device includes a first shift mechanism switchable to a forward moving state and a rearward moving state. The first marine propulsion device is rotatable about a first steering shaft. The first steering actuator rotates the first marine propulsion device about the first steering shaft. The second marine propulsion device includes a second shift mechanism switchable to the forward moving state and the rearward moving state. The second marine propulsion device is rotatable about a second steering shaft. The second steering actuator rotates the second marine propulsion device about the second steering shaft. The controller is configured or programmed to control the first marine propulsion device, the first steering actuator, the second marine propulsion device, and the second steering actuator in a swaying mode to cause translational movement of the watercraft in a sideways direction.

The controller sets either of the first and second shift mechanisms to the forward moving state and sets the other of the first and second shift mechanisms to the rearward moving state, while controlling a rudder angle of the first marine propulsion device and a rudder angle of the second marine propulsion device such that a net thrust of a thrust generated by the first marine propulsion device and a thrust generated by the second marine propulsion device is oriented in the sideways direction in the swaying mode. When setting the first shift mechanism to the forward moving state and setting the second shift mechanism to the rearward moving state in the swaying mode, the controller switches the second shift mechanism to the rearward moving state and then switches the first shift mechanism to the forward moving state after a delay at a start of the swaying mode.

In the above-described system, when the first shift mechanism is set to the forward moving state and the second shift mechanism is set to the rearward moving state in the swaying mode, the second shift mechanism is switched to the rearward moving state and then the first shift mechanism is switched to the forward moving state after a delay at the start of the swaying mode. Because of this, a difference in magnitude of the forward moving directional thrust and the rearward moving directional thrust due to a difference in transient characteristics therebetween is reduced. Accordingly, the watercraft is accurately moved in the swaying mode.

A system according to a second preferred embodiment of the present invention controls a watercraft. The system includes a first marine propulsion device, a second marine propulsion device, and a controller. The first marine propulsion device includes a first shift mechanism switchable to a forward moving state and a rearward moving state. The second marine propulsion device includes a second shift mechanism switchable to the forward moving state and the rearward moving state. The controller is configured or programmed to control the first marine propulsion device and the second marine propulsion device in a bow turning mode to cause the watercraft to perform a bow turning motion.

The controller causes the watercraft to perform the bow turning motion by setting either of the first and second shift mechanisms to the forward moving state and setting the other of the first and second shift mechanisms to the rearward moving state in the bow turning mode. When setting the first shift mechanism to the forward moving state and setting the second shift mechanism to the rearward moving state in the bow turning mode, the controller switches the second shift mechanism to the rearward moving state and then switches the first shift mechanism to the forward moving state after a delay at a start of the bow turning mode.

In the above-described system, when the first shift mechanism is set to the forward moving state and the second shift mechanism is set to the rearward moving state in the bow turning mode, the second shift mechanism is switched to the rearward moving state and then the first shift mechanism is switched to the forward moving state after a delay at the start of the bow turning mode. Because of this, a difference in magnitude of the forward moving directional thrust and the rearward moving directional thrust due to a difference in transient characteristics therebetween is reduced. Accordingly, the watercraft is accurately moved in the bow turning mode.

A system according to a third preferred embodiment of the present invention controls a watercraft. The system includes a first marine propulsion device, a second marine propulsion device, and a controller. The first marine propulsion device includes a first shift mechanism switchable to a forward moving state and a rearward moving state. The second marine propulsion device includes a second shift mechanism switchable to the forward moving state and the rearward moving state. The controller is configured or programmed to control the first marine propulsion device and the second marine propulsion device in a predetermined operating mode.

The controller causes the watercraft to move in the predetermined operating mode by setting either of the first and second shift mechanisms to the forward moving state and setting the other of the first and second shift mechanisms to the rearward moving state. When setting the first shift mechanism to the forward moving state and setting the second shift mechanism to the rearward moving state in the predetermined operating mode, the controller switches the second shift mechanism to the rearward moving state and then switches the first shift mechanism to the forward moving state after a delay at a start of the predetermined operating mode.

In the system described above, when the first shift mechanism is set to the forward moving state and the second shift mechanism is set to the rearward moving state in the predetermined operating mode, the second shift mechanism is switched to the rearward moving state and then the first shift mechanism is switched to the forward moving state after a delay at the start of the predetermined operating mode. Because of this, a difference in magnitude of the forward moving directional thrust and the rearward moving directional thrust due to a difference in transient characteristics therebetween is reduced. Accordingly, the watercraft is accurately moved in the predetermined operating mode.

A system according to a fourth preferred embodiment of the present invention controls a watercraft. The system includes a first marine propulsion device, a second marine propulsion device, and a controller. The first marine propulsion device includes a first engine and a first shift mechanism. The first engine is controlled in accordance with a first throttle command. The first shift mechanism is switchable to a forward moving state and a rearward moving state. The second marine propulsion device includes a second engine and a second shift mechanism. The second engine is controlled in accordance with a second throttle command. The second shift mechanism is switchable to the forward moving state and the rearward moving state. The controller is configured or programmed to control the first marine propulsion device and the second marine propulsion device in a predetermined operating mode.

The controller causes the watercraft to move in the predetermined operating mode by setting either of the first and second shift mechanisms to the forward moving state and setting the other of the first and second shift mechanisms to the rearward moving state. When setting the first shift mechanism to the forward moving state and setting the second shift mechanism to the rearward moving state in the predetermined operating mode, the controller outputs the second throttle command to the second engine and then outputs the first throttle command to the first engine after a delay at a start of the predetermined operating mode.

In the system described above, when the first shift mechanism is set to the forward moving state and the second shift mechanism is set to the rearward moving state in the predetermined operating mode, the second throttle command is outputted to the second engine and then the first throttle command is outputted to the first engine after a delay at the start of the predetermined operating mode. Because of this, a difference in magnitude of the forward moving directional thrust and the rearward moving directional thrust due to a difference in transient characteristics therebetween is reduced. Accordingly, the watercraft is accurately moved in the predetermined operating mode.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
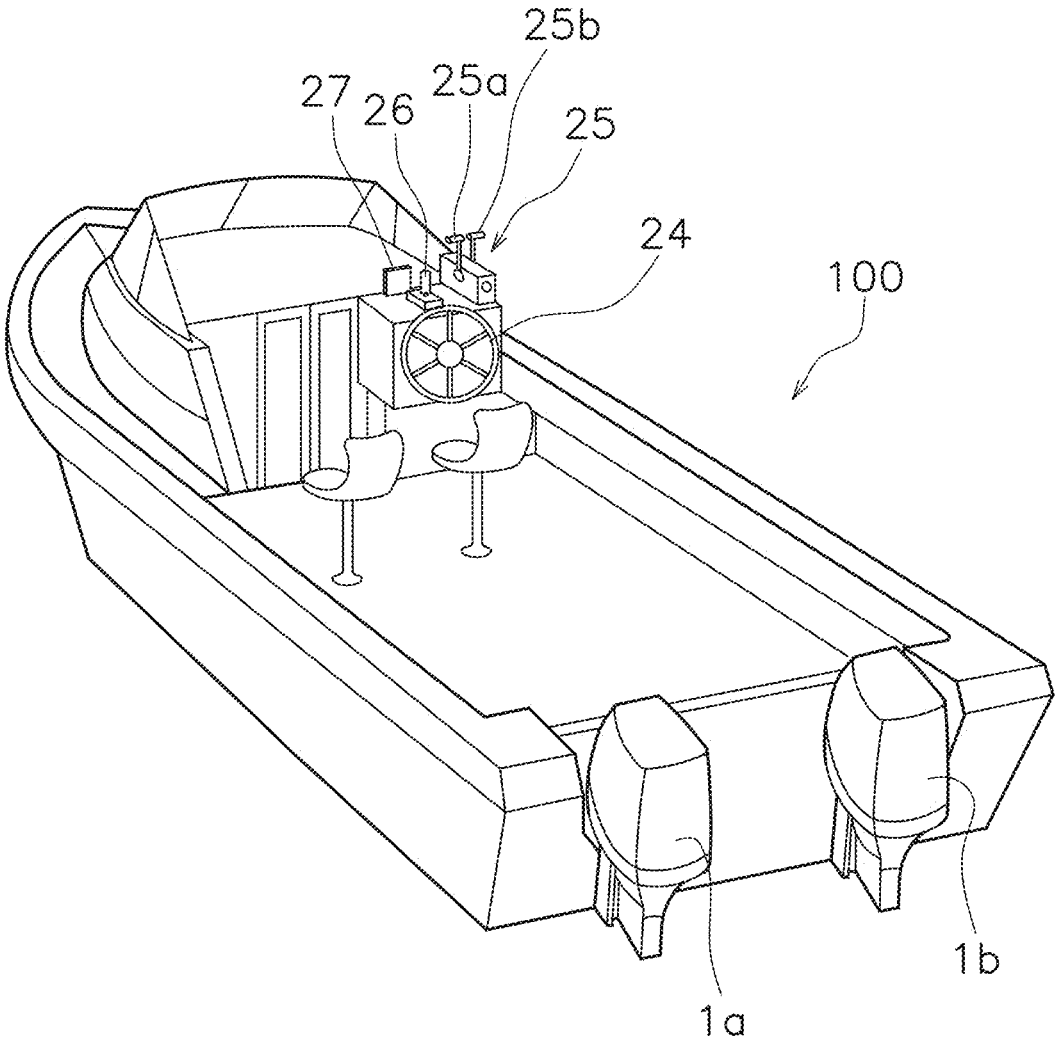
FIG. 1 is a perspective view of a watercraft in which a system according to a preferred embodiment of the present invention is installed.

Preferred embodiments of the present invention will be hereinafter explained with reference to drawings. FIG. 1 is a perspective view of a watercraft 100 in which a system according to a preferred embodiment of the present invention is installed. The system controls the watercraft 100 and includes a first marine propulsion device 1*a* and a second marine propulsion device 1*b*.

The first and second marine propulsion devices 1*a* and 1*b* are attached to the stern of the watercraft 100. The first and second marine propulsion devices 1*a* and 1*b* are outboard motors, for example. The first and second marine propulsion devices 1*a* and 1*b* are aligned in a width direction of the watercraft 100.

Specifically, the first marine propulsion device 1*a* is located on the port side of the watercraft 100. The second marine propulsion device 1*b* is located on the starboard side of the watercraft 100. Each marine propulsion device 1*a*, 1*b* generates a thrust to propel the watercraft 100.

Figure 2:
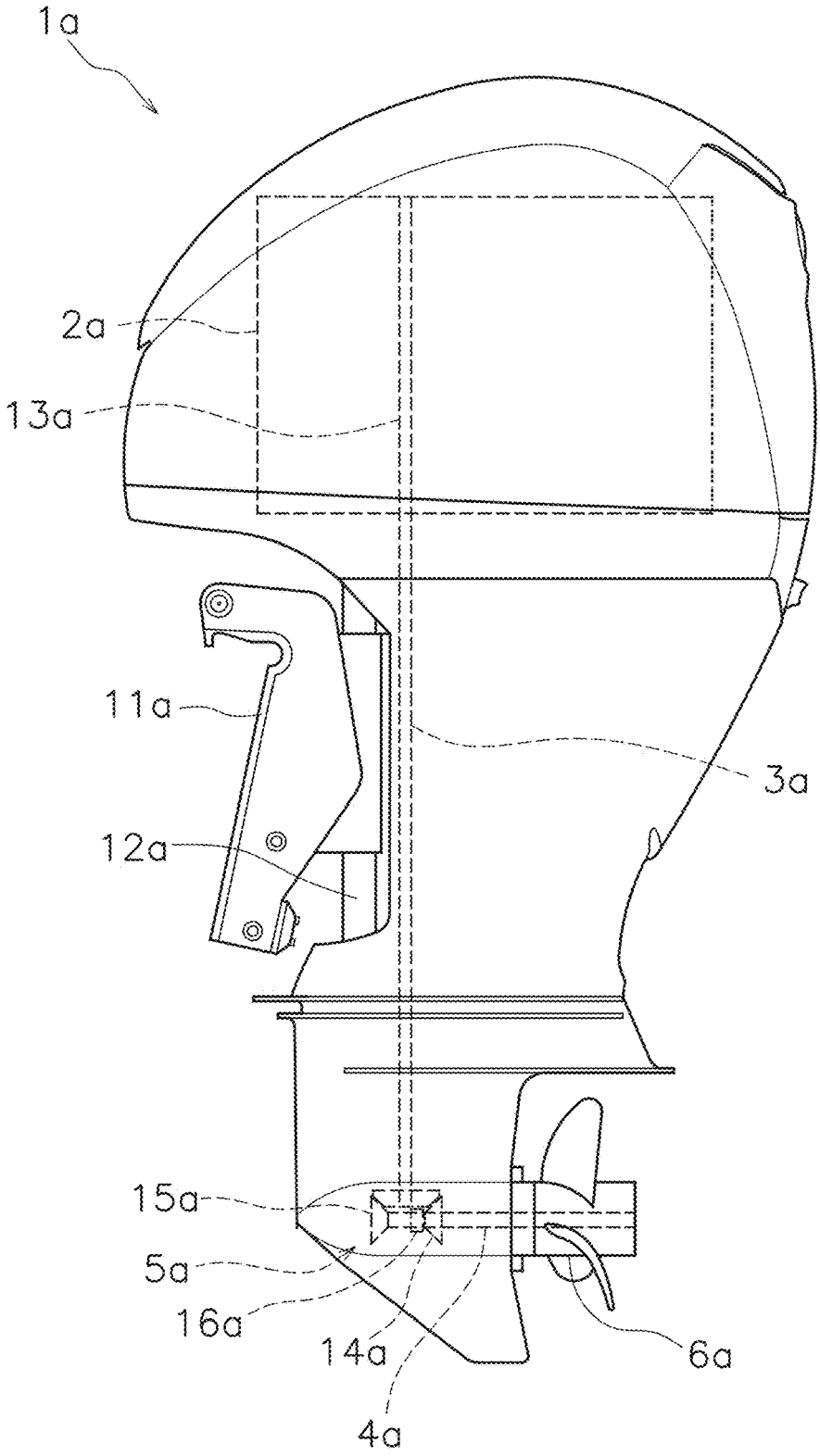
FIG. 2 is a side view of one of marine propulsion devices.

FIG. 2 is a side view of the first marine propulsion device 1*a*. The structure of the first marine propulsion device 1*a* will be hereinafter explained. However, the structure of the first marine propulsion device 1*a* is also true of the second marine propulsion device 1*b*. The first marine propulsion device 1*a* is attached to the watercraft 100 through a bracket 11*a*. The bracket 11*a* supports the first marine propulsion device 1*a* such that the first marine propulsion device 1*a* is rotatable about a first steering shaft 12*a*. The first steering shaft 12*a* extends in an up-and-down direction of the first marine propulsion device 1*a*.

The first marine propulsion device 1*a* includes a first engine 2*a*, a first drive shaft 3*a*, a first propeller shaft 4*a*, and a first shift mechanism 5*a*. The first engine 2*a* generates the thrust to propel the watercraft 100. The first engine 2*a* is an internal combustion engine, for example. The first engine 2*a* includes a crankshaft 13*a*. The crankshaft 13*a* extends in the up-and-down direction of the first marine propulsion device 1*a*. The first drive shaft 3*a* is connected to the crankshaft 13*a*. The first drive shaft 3*a* extends in the up-and-down direction of the first marine propulsion device 1*a*. The first propeller shaft 4*a* extends in a back-and-forth direction of the first marine propulsion device 1*a*. The first propeller shaft 4*a* is connected to the first drive shaft 3*a* through the first shift mechanism 5*a*. A propeller 6*a* is attached to the first propeller shaft 4*a*.

The first shift mechanism 5*a* includes a forward moving gear 14*a*, a rearward moving gear 15*a*, and a dog clutch 16*a*. When gear engagement of each gear 14*a*, 15*a* is switched by the dog clutch 16, the direction of rotation transmitted from the first drive shaft 3*a* to the propeller shaft 4*a* is switched. Movement of the watercraft 100 is thus switched between forward movement and rearward movement.

More specifically, the first shift mechanism 5*a* is switchable among a forward moving state, a rearward moving state, and a neutral state. When the first shift mechanism 5*a* is set in the forward moving state, the dog clutch 16*a* is connected to the forward moving gear 14*a*. Accordingly, the rotation of the first drive shaft 3*a* is transmitted to the first propeller shaft 4*a* so as to rotate the first propeller shaft 4*a* in a rotational direction corresponding to a forward moving direction. When the first shift mechanism 5*a* is set in the rearward moving state, the dog clutch 16*a* is connected to the rearward moving gear 15*a*. Accordingly, the rotation of the first drive shaft 3*a* is transmitted to the first propeller shaft 4*a* so as to rotate the first propeller shaft 4*a* in a rotational direction corresponding to a rearward moving direction. When the first shift mechanism 5*a* is set in the neutral state, the dog clutch 16*a* is released from being connected to each of the forward moving gear 14*a* and the rearward moving gear 15*a*. Accordingly, the rotation of the first drive shaft 3*a* is not transmitted to the first propeller shaft 4*a*.

Figure 3:
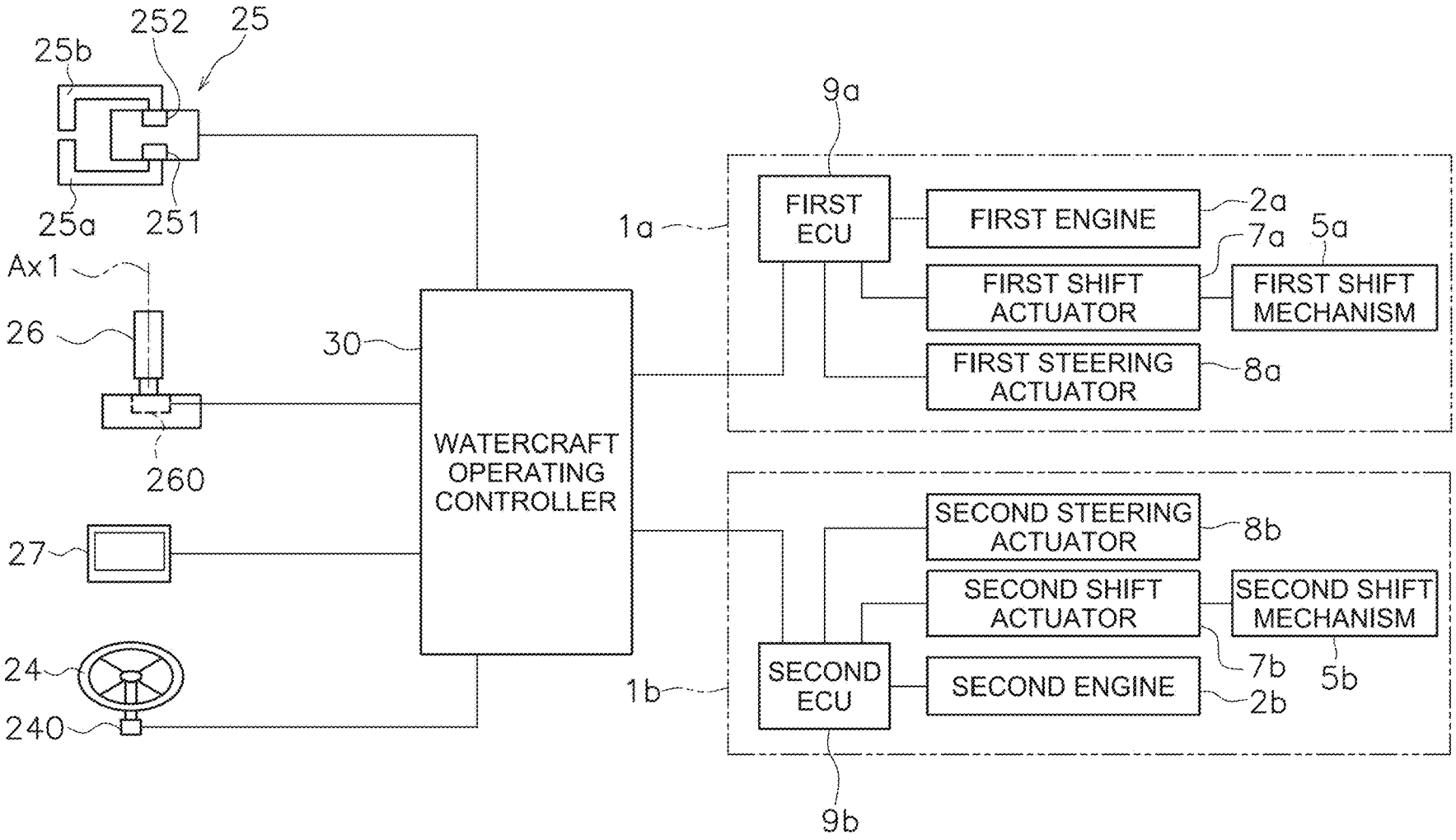
FIG. 3 is a schematic diagram showing a configuration of the system.

FIG. 3 is a schematic diagram of the system for controlling the watercraft 100. As shown in FIG. 3, the first marine propulsion device 1*a* includes a first shift actuator 7*a* and a first steering actuator 8*a*. The first shift actuator 7*a* is connected to the dog clutch 16*a* of the first shift mechanism 5*a*. The first shift actuator 7*a* actuates the dog clutch 16*a* to switch gear engagement of each gear 14*a*, 15*a*. Movement of the watercraft 100 is thus switched between forward movement and rearward movement. The first shift actuator 7*a* is, for instance, an electric motor. However, the first shift actuator 7*a* may be another type of actuator such as an electric cylinder, a hydraulic motor, or a hydraulic cylinder.

The first steering actuator 8*a* is connected to the first marine propulsion device 1*a*. The first steering actuator 8*a* rotates the first marine propulsion device 1*a* about the first steering shaft 12*a*. Accordingly, the rudder angle of the first marine propulsion device 1*a* is changed. The rudder angle refers to an angle of the first propeller shaft 4*a* with respect to the back-and-forth direction of the first marine propulsion device 1*a*. The first steering actuator 8*a* is, for instance, an electric motor. However, the first steering actuator 8*a* may be another type of actuator such as an electric cylinder, a hydraulic motor, or a hydraulic cylinder.

The first marine propulsion device 1*a* includes a first ECU (Electric Control Unit) 9*a*. The first ECU 9*a* includes a processor such as a CPU (Central Processing Unit) and memories such as a RAM (Random Access Memory) and a ROM (Read Only Memory). The first ECU 9*a* stores a program and data to control the first marine propulsion device 1*a*. The first ECU 9*a* controls the first engine 2*a*.

The second marine propulsion device 1*b* includes a second engine 2*b*, a second shift mechanism 5*b*, a second shift actuator 7*b*, a second steering actuator 8*b*, and a second ECU 9*b*. The second marine propulsion device 1*b* is rotatable about a second steering shaft 12*b* (see FIG. 4). The second engine 2*b*, the second shift mechanism 5*b*, the second shift actuator 7*b*, the second steering actuator 8*b*, and the second ECU 9*b* in the second marine propulsion device 1*b* are configured in a similar manner to the first engine 2*a*, the first shift mechanism 5*a*, the first shift actuator 7*a*, the first steering actuator 8*a*, and the first ECU 9*a* in the first marine propulsion device 1*a*, respectively.

The system includes a steering wheel 24, a remote controller 25, a joystick 26, and an input device 27. As shown in FIG. 1, the steering wheel 24, the remote controller 25, the joystick 26, and the input device 27 are located in a cockpit of the watercraft 100.

The steering wheel 24 allows a user to operate a turning direction of the watercraft 100. The steering wheel 24 includes a sensor 240. The sensor 240 outputs a steering signal indicating an operating direction and an operating amount of the steering wheel 24.

The remote controller 25 includes a first throttle lever 25*a* and a second throttle lever 25*b*. The first throttle lever 25*a* allows the user to regulate the magnitude of the thrust generated by the first marine propulsion device 1*a*. The first throttle lever 25*a* also allows the user to switch the direction of the thrust generated by the first marine propulsion device 1*a* between the forward moving direction and the rearward moving direction. The first throttle lever 25*a* is operable from a neutral position to a forward moving directional side and a rearward moving directional side. The neutral position is a position located between the forward moving directional side and the rearward moving directional side. The first throttle lever 25*a* includes a sensor 251. The sensor 251 outputs a first throttle signal indicating an operating direction and an operating amount of the first throttle lever 25*a*.

The second throttle lever 25*b* allows the user to regulate the magnitude of the thrust generated by the second marine propulsion device 1*b*. The second throttle lever 25*b* also allows the user to switch the direction of the thrust generated by the second marine propulsion device 1*b* between the forward moving direction and the rearward moving direction. The second throttle lever 25*b* is configured in a similar manner to the first throttle lever 25*a*. The second throttle lever 25*b* includes a sensor 252. The sensor 252 outputs a second throttle signal indicating an operating direction and an operating amount of the second throttle lever 25*b*.

The joystick 26 is an operating device or operator that is operable by the user to select one of a plurality of operating modes, in which the watercraft 100 moves in the directions of front, rear, right, and left. The joystick 26 is also operable by the user to select a bow turning mode, in which the watercraft 100 performs a bow turning motion. The joystick 26 is tiltable from a neutral position in at least four directions of front, rear, right, and left. Four or more directions, and furthermore, all directions may be indicated by the joystick 26. The joystick 26 is rotatable (twistable) about a rotational axis Ax1. In other words, the joystick 26 is operable to be twisted clockwise and counterclockwise about the rotational axis Ax1 from the neutral position.

The joystick 26 includes a sensor 260. The sensor 260 outputs a joystick signal that indicates an operation on the joystick 26. The joystick signal contains information regarding a tilt direction and a tilt amount of the joystick 26. The joystick signal also contains information regarding a twist direction and a twist amount of the joystick 26.

The input device 27 is operable to set one of the operating modes. The input device 27 is, for instance, a touchscreen or at least one switch. The input device 27 outputs a setting signal indicating the setting of the operating mode inputted into the input device 27.

The system includes a watercraft operating controller 30. The watercraft operating controller 30 includes a processor such as a CPU and memories such as a RAM and a ROM. The watercraft operating controller 30 stores programs and data to control the first and second marine propulsion devices 1*a* and 1*b*. The watercraft operating controller 30 is connected to the first and second ECUs 9*a* and 9*b* through wired or wireless communication. The watercraft operating controller 30 is connected to the steering wheel 24, the remote controller 25, the joystick 26, and the input device 27.

The watercraft operating controller 30 receives the steering signal from the sensor 240. The watercraft operating controller 30 receives the throttle signal from each sensor 251, 252. The watercraft operating controller 30 receives the joystick signal from the sensor 260. The watercraft operating controller 30 outputs command signals to the first and second ECUs 9*a* and 9*b* based on the signals received from the sensors 240, 251, 252, and 260.

Command signals are transmitted to the first engine 2*a*, the first shift actuator 7*a*, and the first steering actuator 8*a* through the first ECU 9*a*. Command signals are transmitted to the second engine 2*b*, the second shift actuator 7*b*, and the second steering actuator 8*b* through the second ECU 9*b*.

The watercraft operating controller 30 outputs a first shift command for the first shift actuator 7*a* in accordance with the operating direction of the first throttle lever 25*a*. In response, shifting between forward movement and rearward movement by the first marine propulsion device 1*a* is performed. The watercraft operating controller 30 outputs a first throttle command for the first engine 2*a* in accordance with the operating amount of the first throttle lever 25*a*. The first ECU 9*a* controls the thrust of the first marine propulsion device 1*a* in accordance with the first throttle command. It should be noted that the first throttle signal outputted from the sensor 251 may be directly inputted to the first ECU 9*a*. The first ECU 9*a* may output the first throttle command to the first engine 2*a* in accordance with the first throttle signal received from the sensor 251.

The watercraft operating controller 30 outputs a second shift command for the second shift actuator 7*b* in accordance with the operating direction of the second throttle lever 25*b*. In response, shifting between forward movement and rearward movement by the second marine propulsion device 1*b* is performed. The watercraft operating controller 30 outputs a second throttle command for the second engine 2*b* in accordance with the operating amount of the second throttle lever 25*b*. The second ECU 9*b* controls the thrust of the second marine propulsion device 1*b* in accordance with the second throttle command. It should be noted that the second throttle signal outputted from the sensor 252 may be directly inputted to the second ECU 9*b*. The second ECU 9*b* may output the second throttle command to the second engine 2*b* in accordance with the second throttle signal received from the sensor 252.

The watercraft operating controller 30 outputs a command signal for each of the first and second steering actuators 8*a* and 8*b* in accordance with the operating direction and the operating amount of the steering wheel 24. When the steering wheel 24 is operated leftward from the neutral position, the watercraft operating controller 30 controls the first and second steering actuators 8*a* and 8*b* such that the first and second marine propulsion devices 1*a* and 1*b* are rotated rightward. The watercraft 100 thus turns leftward.

When the steering wheel 24 is operated rightward from the neutral position, the watercraft operating controller 30 controls the first and second steering actuators 8*a* and 8*b* such that the first and second marine propulsion devices 1*a* and 1*b* are rotated leftward. The watercraft 100 thus turns rightward. Additionally, the watercraft operating controller 30 controls the rudder angle of the first marine propulsion device 1*a* and that of the second marine propulsion device 1*b* depending on the operating amount of the steering wheel 24.

The watercraft operating controller 30 outputs the command signals to each first/second engine 2*a*, 2*b*, each first/second shift actuator 7*a*, 7*b*, and each first/second steering actuator 8*a*, 8*b* in accordance with the tilt direction and the tilt amount of the joystick 26. The watercraft operating controller 30 controls each first/second engine 2*a*, 2*b*, each first/second shift actuator 7*a*, 7*b*, and each first/second steering actuator 8*a*, 8*b* such that translational movement of the watercraft 100 is made at a velocity corresponding to the tilt amount of the joystick 26 in a direction corresponding to the tilt direction of the joystick 26.

When the joystick 26 is being tilted forward, the watercraft operating controller 30 moves the watercraft 100 forward (fore surging mode). When the joystick 26 is being tiled rearward, the watercraft operating controller 30 moves the watercraft 100 rearward (aft surging mode).

Figure 4:
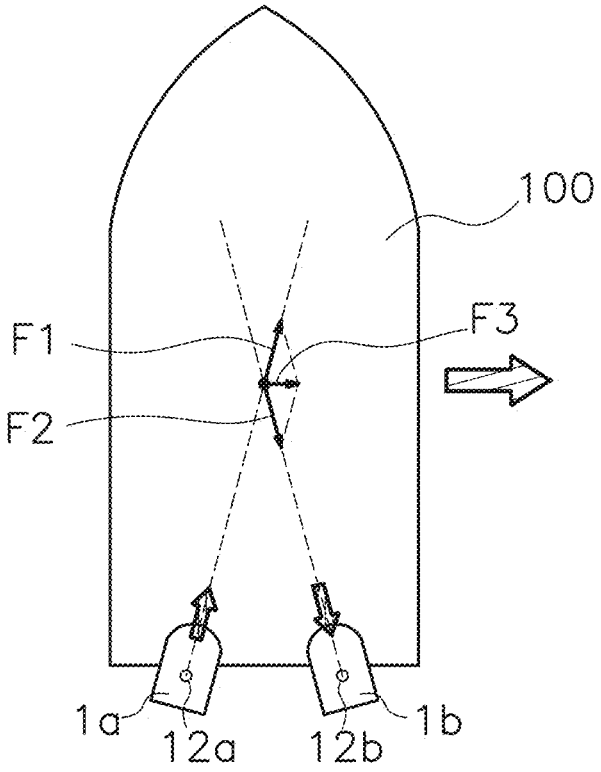
FIG. 4 is a schematic diagram showing controls of the marine propulsion devices in a leftward swaying mode.

When the joystick 26 is being tilted rightward or leftward, the watercraft operating controller 30 moves the watercraft 100 sideways either right or left (swaying mode). For example, when the joystick 26 is being tilted rightward, as shown in FIG. 4, the watercraft operating controller 30 causes the first marine propulsion device 1*a* to generate a thrust F1 oriented in the forward moving direction, and simultaneously, causes the second marine propulsion device 1*b* to generate a thrust F2 oriented in the rearward moving direction. The watercraft operating controller 30 controls the thrust and the rudder angle of each first/second marine propulsion device 1*a*, 1*b* such that a net thrust F3 of the thrust F1 of the first marine propulsion device 1*a* and the thrust F2 of the second marine propulsion device 1*b* is oriented rightward from the watercraft 100. Translational movement of the watercraft 100 is thus made straightly rightward.

Figure 5:
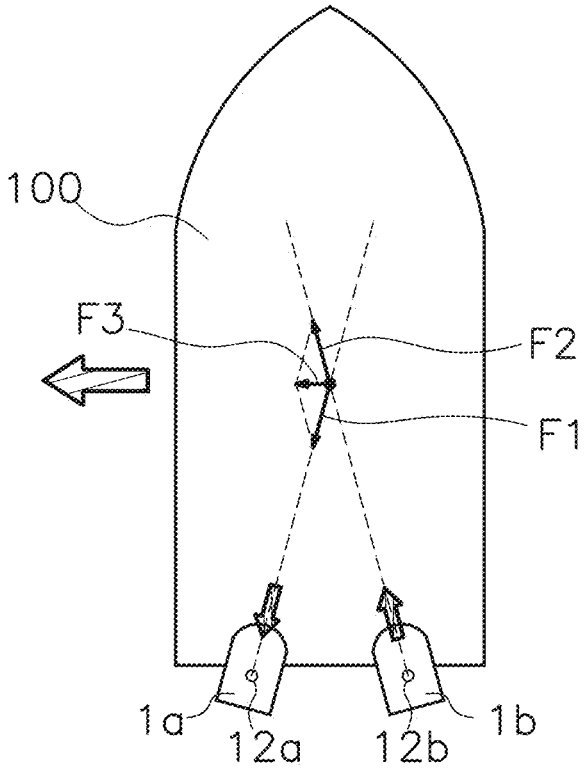
FIG. 5 is a schematic diagram showing controls of the marine propulsion devices in a rightward swaying mode.

When the joystick 26 is being tilted leftward, as shown in FIG. 5, the watercraft operating controller 30 causes the first marine propulsion device 1*a* to generate the thrust F1 oriented in the rearward moving direction, and simultaneously, causes the second marine propulsion device 1*b* to generate the thrust F2 oriented in the forward moving direction. The watercraft operating controller 30 controls the thrust and the rudder angle of each first/second marine propulsion device 1*a*, 1*b* such that the net thrust F3 of the thrust F1 of the first marine propulsion device 1*a* and the thrust F2 of the second marine propulsion device 1*b* is oriented leftward from watercraft 100. Translational movement of the watercraft 100 is thus made straightly leftward.

Figure 6:
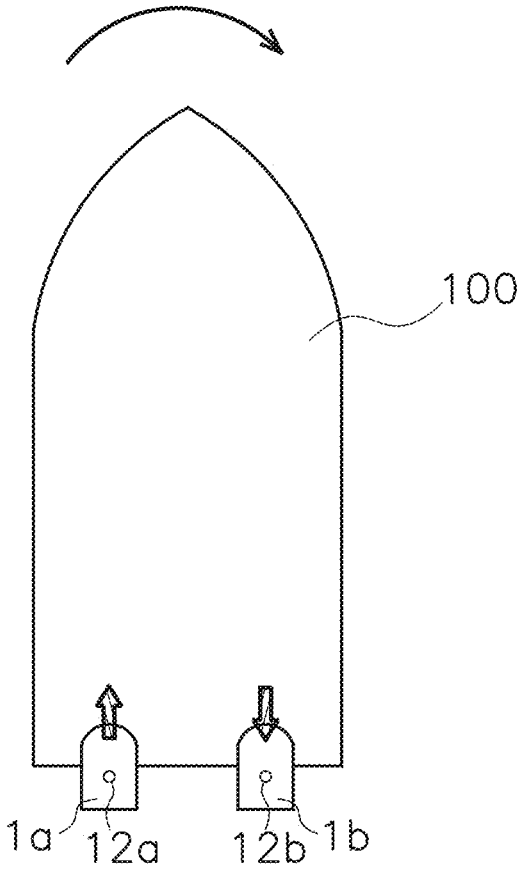
FIG. 6 is a schematic diagram showing controls of the marine propulsion devices in a clockwise bow turning mode.

The watercraft operating controller 30 controls the first and second engines 2*a* and 2*b*, the first and second shift actuators 7*a* and 7*b*, and the first and second steering actuators 8*a* and 8*b* such that a bow turning motion of the watercraft 100 is made at a velocity corresponding to the twist amount of the joystick 26 in a direction corresponding to the twist direction of the joystick 23 (bow turning mode). For example, when the joystick 26 is twisted clockwise, as shown in FIG. 6, the watercraft operating controller 30 causes the first marine propulsion device 1*a* to generate the thrust oriented in the forward moving direction, and simultaneously, causes the second marine propulsion device 1*b* to generate the thrust oriented in the rearward moving direction. The bow turning motion of the watercraft 100 is thus made clockwise.

Figure 7:
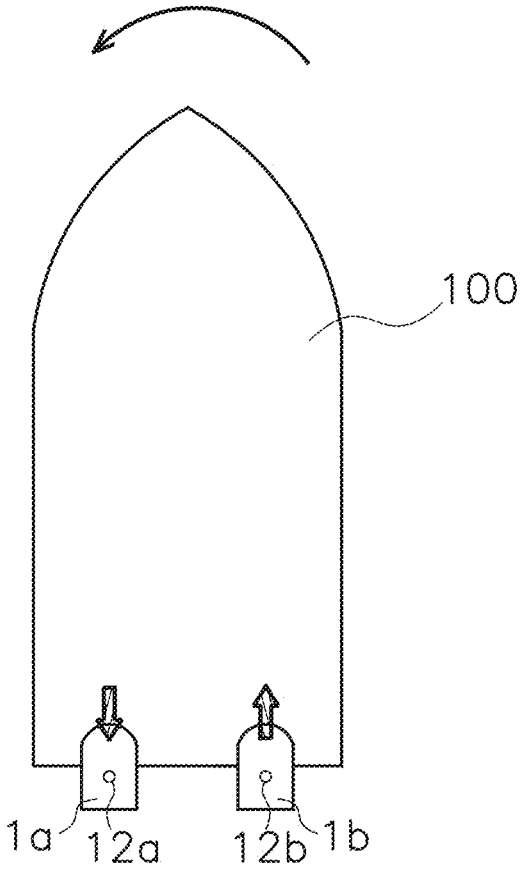
FIG. 7 is a schematic diagram showing controls of the marine propulsion devices in a counterclockwise bow turning mode.

When the joystick 26 is twisted counterclockwise, as shown in FIG. 7, the watercraft operating controller 30 causes the first marine propulsion device 1*a* to generate the thrust oriented in the rearward moving direction, and simultaneously, causes the second marine propulsion device 1*b* to generate the thrust oriented in the forward moving direction. The bow turning motion of the watercraft 100 is thus counterclockwise.

At the start of the swaying mode described above, the watercraft operating controller 30 executes a shift delay control to delay shifting to the forward moving state. In the shift delay control, the watercraft operating controller 30 switches the shift mechanism 5*a*, 5*b* of one marine propulsion device 1*a*, 1*b* to the rearward moving state, and then after a delay, switches the shift mechanism 5*b*, 5*a* of the other marine propulsion device 1*b*, 1*a* to the forward moving state.

For example, at the start of the rightward swaying mode, the watercraft operating controller 30 switches the second shift mechanism 5*b* of the second marine propulsion device 1*b* to the rearward moving state, and then after a delay, switches the first shift mechanism 5*a* of the first marine propulsion device 1*a* to the forward moving state. At the start of the leftward swaying mode, the watercraft operating controller 30 switches the first shift mechanism 5*a* of the first marine propulsion device 1*a* to the rearward moving state, and then after a delay, switches the second shift mechanism 5*b* of the second marine propulsion device 1*b* to the forward moving state.

Figure 8:
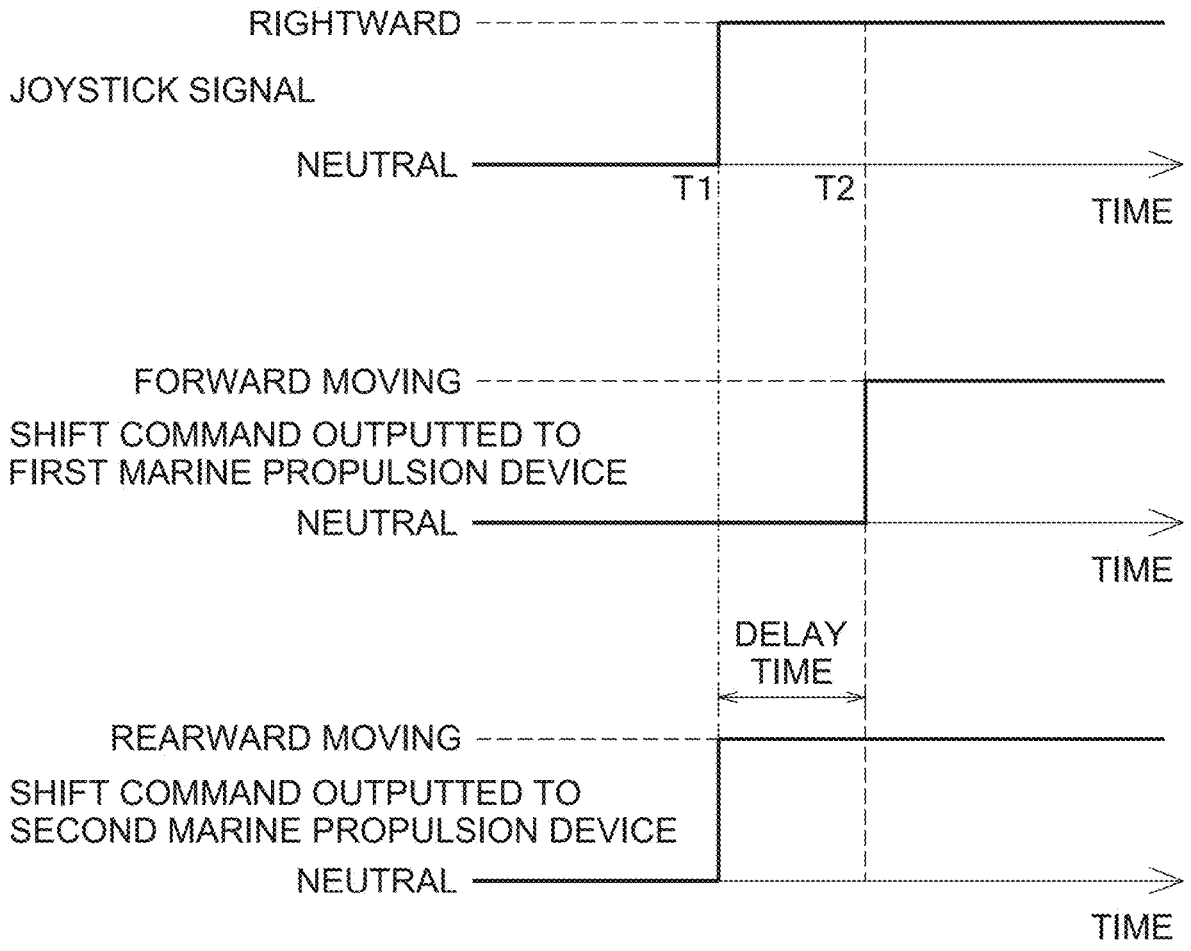
FIG. 8 is a timing chart showing the controls of the marine propulsion devices in the rightward swaying mode.

FIG. 8 is a timing chart showing the joystick signal and the shift commands at the start of the rightward swaying mode. As shown in FIG. 8, the watercraft operating controller 30 receives the joystick signal that indicates tilting of the joystick 26 rightward at time T1. In response, the watercraft operating controller 30 starts the rightward swaying mode. When receiving the joystick signal that indicates tilting of the joystick 26 rightward at time T1, first, the watercraft operating controller 30 outputs the shift command to switch to the rearward moving state to the second marine propulsion device 1*b*, such that the second shift mechanism 5*b* is switched to the rearward moving state. Subsequently, at time T2, in other words, after elapse of a delay time from time T1, the watercraft operating controller 30 outputs the shift command to switch to the forward moving state to the first marine propulsion device 1*a*, such that the first shift mechanism 5*a* is switched to the forward moving state.

Figure 9:
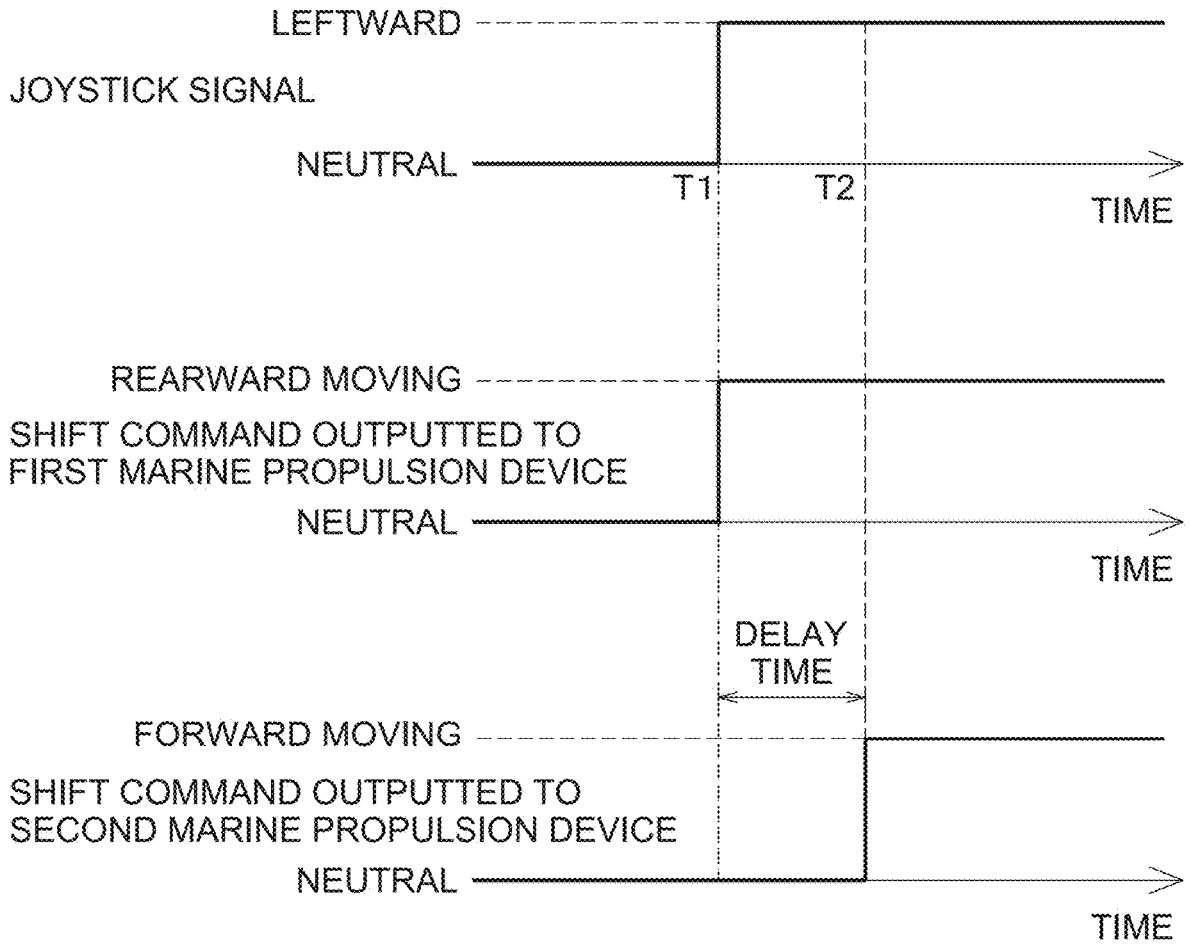
FIG. 9 is a timing chart showing the controls of the marine propulsion devices in the leftward swaying mode.

FIG. 9 is a timing chart showing the joystick signal and the shift commands at the start of the leftward swaying mode. As shown in FIG. 9, the watercraft operating controller 30 receives the joystick signal that indicates tilting of the joystick 26 leftward at time T1. In response, the watercraft operating controller 30 starts the leftward swaying mode. When receiving the joystick signal that indicates tilting of the joystick 26 leftward at time T1, the watercraft operating controller 30 firstly outputs the shift command to switch to the rearward moving state to the first marine propulsion device 1*a*, such that the first shift mechanism 5*a* is switched to the rearward moving state. Subsequently, at time T2, in other words, after elapse of the delay time from time T1, the watercraft operating controller 30 outputs the shift command to switch to the forward moving state to the second marine propulsion device 1*b*, such that the second shift mechanism 5*b* is switched to the forward moving state.

The watercraft operating controller 30 changes the delay time during the shift delay control depending on the magnitude of a requested thrust oriented in the forward moving direction. With reference to the delay time data, the watercraft operating controller 30 determines the delay time based on the requested forward moving directional thrust. The delay time data defines a relationship between the requested forward moving directional thrust and the delay time. The watercraft operating controller 30 stores the delay time data.

For example, the watercraft operating controller 30 determines the forward moving directional thrust requested for the first marine propulsion device 1*a* and the rearward moving directional thrust requested for the second marine propulsion device 1*b* depending on the amount of tilting the joystick 26 rightward. The watercraft operating controller 30 determines the delay time at the start of the rightward swaying mode based on the forward moving directional thrust requested for the first marine propulsion device 1*a*. The watercraft operating controller 30 determines the rearward moving directional thrust requested for the first marine propulsion device 1*a* and the forward moving directional thrust requested for the second marine propulsion device 1*b* depending on the tilt amount of tilting the joystick 26 leftward. The watercraft operating controller 30 determines the delay time at the start of the leftward swaying mode based on the forward moving directional thrust requested for the second marine propulsion device 1*b*.

Figure 10:
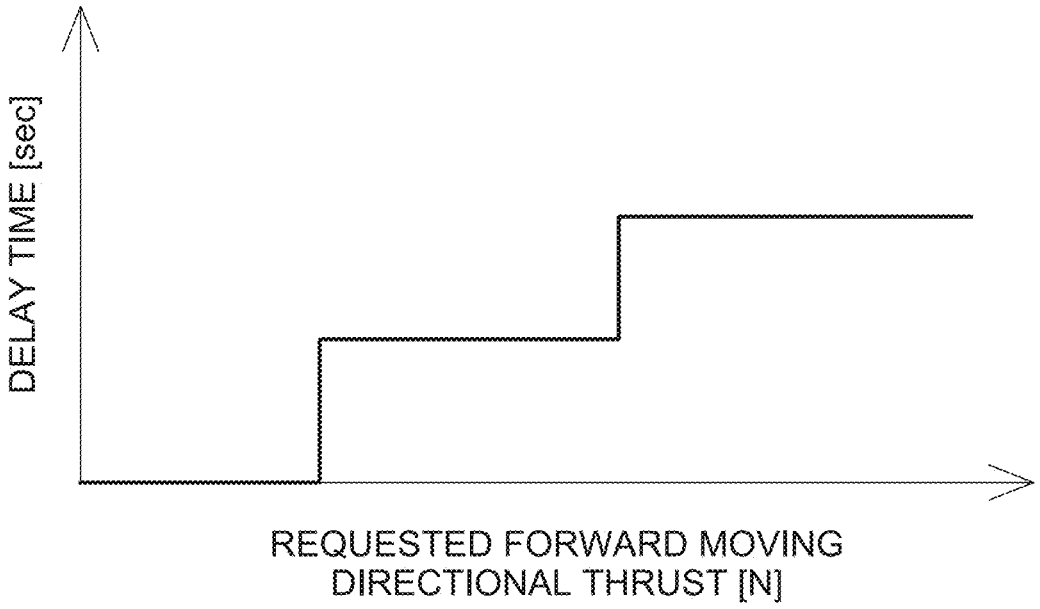
FIG. 10 is a diagram showing exemplary delay time data.

FIG. 10 is a chart exemplifying the delay time data. As shown in FIG. 10, the delay time data defines that the delay time increases stepwise with an increase in the requested forward moving directional thrust. It should be noted that the delay time data is not limited to that shown in FIG. 10, and alternatively, may define any suitable relationship different from the above. For example, the delay time data may define that the delay time linearly increases with an increase in the requested forward moving directional thrust. Alternatively, the delay time data may define that the delay time increases in a curved shape with an increase in the requested forward moving directional thrust.

The watercraft operating controller 30 executes the shift delay control when the joystick 26 is operated rightward or leftward from the neutral position. The watercraft operating controller 30 executes the shift delay control when the joystick 26, which is being operated rearward, is operated therefrom rightward or leftward. The watercraft operating controller 30 executes the shift delay control when the joystick 26, which is being operated rightward or leftward, is operated therefrom in a reverse direction.

It should be noted that the watercraft operating controller 30 does not execute the shift delay control when the joystick 26, which is being operated forward, is operated therefrom rightward or leftward. In other words, when the instruction made by the joystick 26 is changed from the fore surging mode to the swaying mode, the watercraft operating controller 30 switches to the forward moving state the shift mechanism of one marine propulsion device intended to switch to the forward moving state without delay at the start of the swaying mode.

The watercraft operating controller 30 executes the shift delay control at the start of the bow turning mode. For example, at the start of the clockwise bow turning mode, the watercraft operating controller 30 switches the second shift mechanism 5*b* of the second marine propulsion device 1*b* to the rearward moving state, and then after a delay, switches the first shift mechanism 5*a* of the first marine propulsion device 1*a* to the forward moving state. At the start of the counterclockwise bow turning mode, the watercraft operating controller 30 switches the first shift mechanism 5*a* of the first marine propulsion device 1*a* to the rearward moving state, and then after a delay, switches the second shift mechanism 5*b* of the second marine propulsion device 1*b* to the forward moving state.

Figure 11:
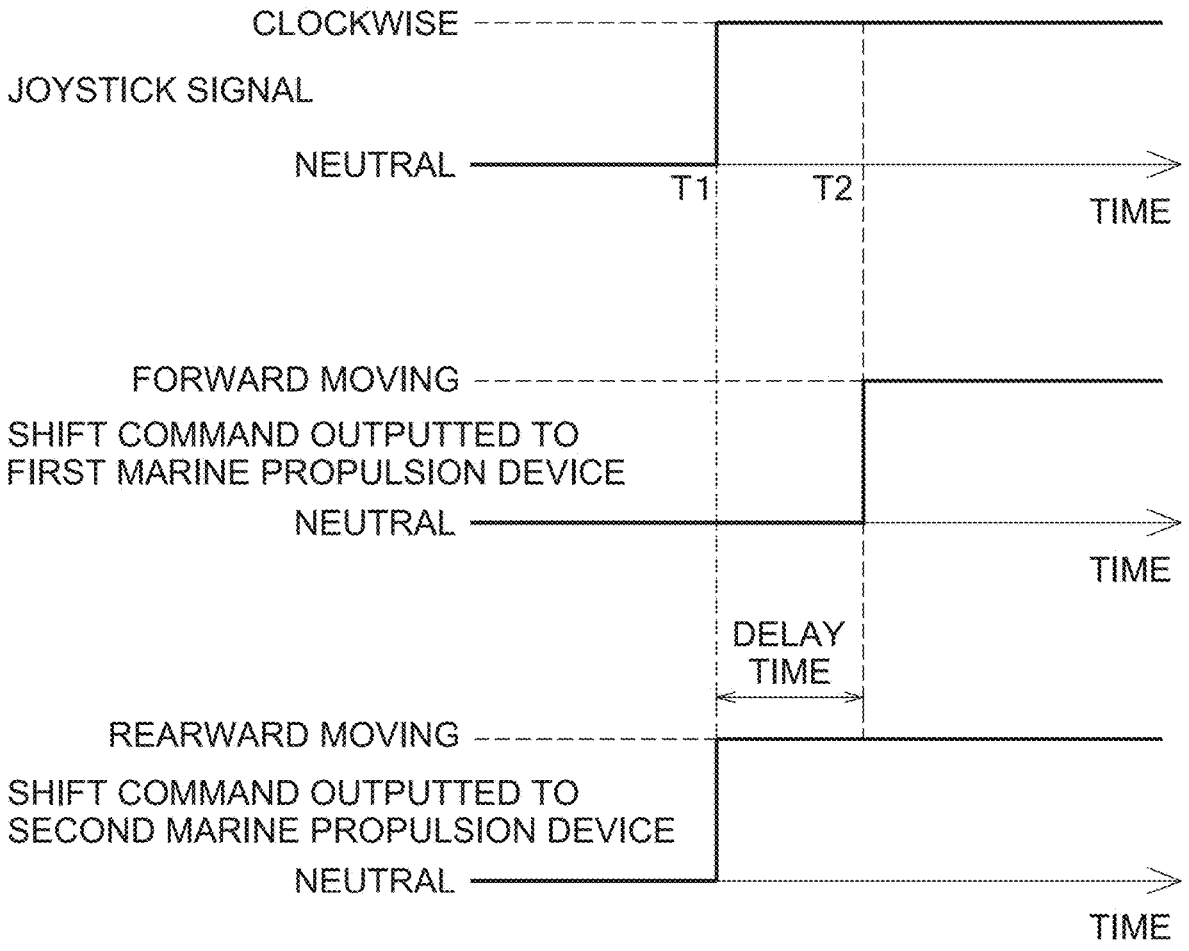
FIG. 11 is a timing chart showing the controls of the marine propulsion devices in the clockwise bow turning mode.

FIG. 11 is a timing chart showing the joystick signal and the shift commands at the start of the clockwise bow turning mode. As shown in FIG. 11, the watercraft operating controller 30 receives the joystick signal that indicates twisting of the joystick 26 clockwise at time T1. In response, the watercraft operating controller 30 starts the clockwise bow turning mode. When receiving the joystick signal that indicates twisting of the joystick 26 clockwise at time T1, the watercraft operating controller 30 firstly outputs the shift command to switch to the rearward moving state to the second marine propulsion device 1*b*, such that the second shift mechanism 5*b* is switched to the rearward moving state. Subsequently, at time T2, in other words, after elapse of the delay time from time T1, the watercraft operating controller 30 outputs the shift command to switch to the forward moving state to the first marine propulsion device 1*a*, such that the first shift mechanism 5*a* is switched to the forward moving state.

Figure 12:
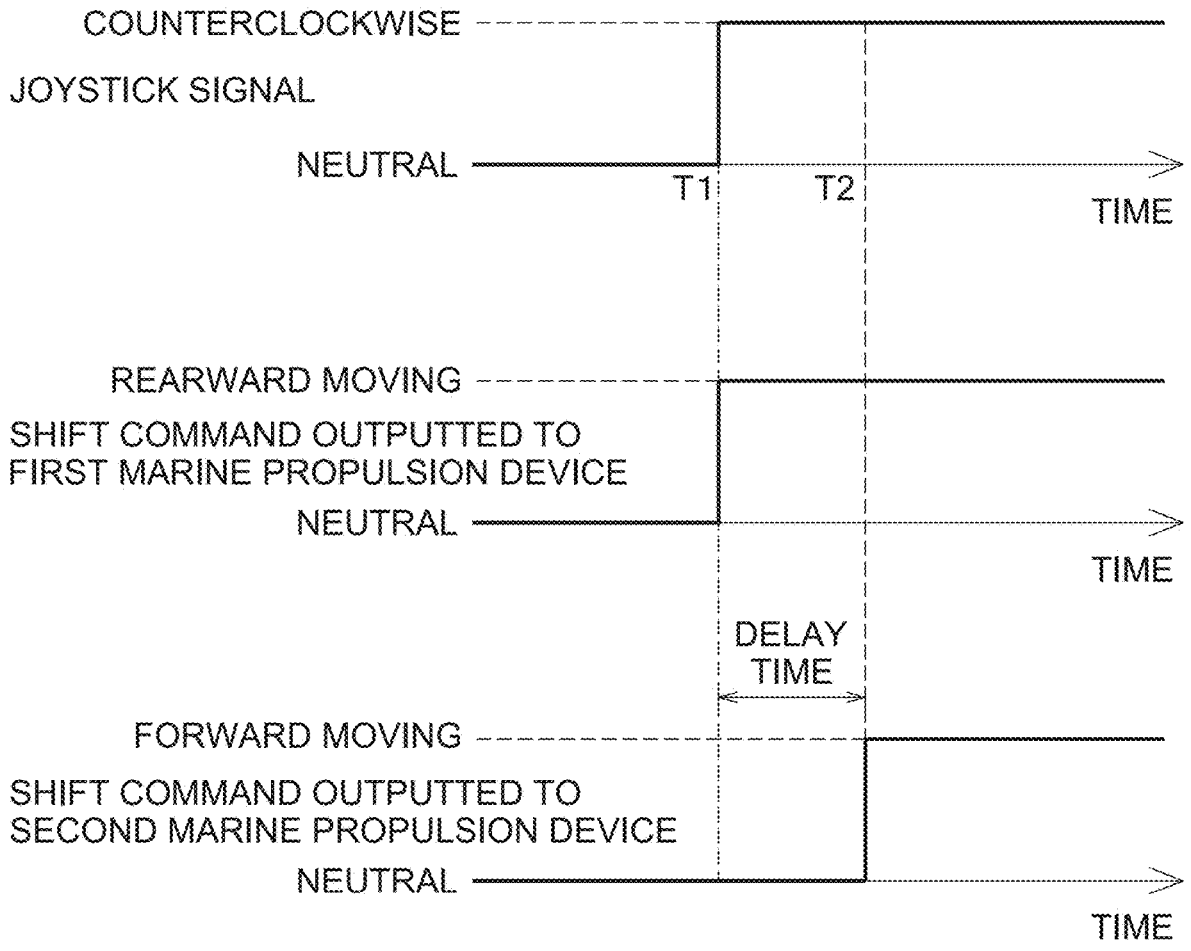
FIG. 12 is a timing chart showing the controls of the marine propulsion devices in the counterclockwise bow turning mode.

FIG. 12 is a timing chart showing the joystick signal and the shift commands at the start of the counterclockwise bow turning mode. As shown in FIG. 12, the watercraft operating controller 30 receives the joystick signal that indicates twisting of the joystick 26 counterclockwise at time T1. In response, the watercraft operating controller 30 starts the counterclockwise bow turning mode. When receiving the joystick signal that indicates twisting of the joystick 26 counterclockwise at time T1, the watercraft operating controller 30 firstly outputs the shift command to switch to the rearward moving state to the first marine propulsion device 1*a*, such that the first shift mechanism 5*a* is switched to the rearward moving state. Subsequently, at time T2, in other words, after elapse of the delay time from time T1, the watercraft operating controller 30 outputs the shift command to switch to the forward moving state to the second marine propulsion device 1*b*, such that the second shift mechanism 5*b* is switched to the forward moving state. It should be noted that the watercraft operating controller 30 changes the delay time at the start of the bow turning mode depending on the magnitude of the requested forward moving directional thrust in a similar manner to when the swaying mode is started.

When the joystick 26 is twisted clockwise or counterclockwise from the neutral position, the watercraft operating controller 30 executes the shift delay control. When the joystick 26, which is being twisted clockwise or counterclockwise, is twisted therefrom in a reverse direction, the watercraft operating controller 30 executes the shift delay control.

It should be noted that when the joystick 26, which is being tilted forward, rearward, leftward, or rightward, is twisted therefrom clockwise or counterclockwise, the watercraft operating controller 30 does not execute the shift delay control. In other words, when the instruction made by the joystick 26 is changed from the forward, rearward, rightward, or leftward moving mode to the bow turning mode, the watercraft operating controller 30 switches to the forward moving state the shift mechanism of one marine propulsion device intended to switch to the forward moving state without delay at the start of the bow turning mode.

In the systems according to the preferred embodiments explained above, the shift delay control is executed in the swaying mode and the bow turning mode. Because of this, a difference in magnitude of the forward moving directional thrust and the rearward moving directional thrust due to a difference in transient characteristics therebetween is reduced. Accordingly, the watercraft 100 is accurately moved in the swaying mode and the bow turning mode.

Preferred embodiments of the present invention have been explained above. However, the present invention is not limited to the preferred embodiments described above, and a variety of changes can be made without departing from the gist of the present invention.

Each marine propulsion device is not limited to the outboard motor, and alternatively, another type of device may be used. For example, each marine propulsion device may be an inboard engine outboard drive or a jet propulsion device. The number of marine propulsion devices is not limited to two and may be greater than two.

In the preferred embodiments described above, the joystick is exemplified as an operating device to select the operating mode. However, the operating device is not limited to the joystick, and alternatively, another type of device may be used. For example, the operating device may be at least one switch, a touchscreen, or so forth.

In the preferred embodiments described above, a difference in magnitude of the forward moving directional thrust and the rearward moving directional thrust due to a difference in transient characteristics therebetween is reduced by the shift delay control. However, the watercraft operating controller 30 may reduce the difference in magnitude of the thrusts by throttle delay control. In the throttle delay control, the watercraft operating controller 30 outputs a throttle signal to the engine of one marine propulsion device intended to switch to the rearward moving state, and then after a delay, outputs a throttle signal to the engine of the other marine propulsion device intended to switch to the forward moving state.

For example, the watercraft operating controller 30 may output the second throttle signal to the second engine 2*b*, and then after a delay, output the first throttle signal to the first engine 2*a* at the start of the rightward swaying mode. The watercraft operating controller 30 may output the first throttle signal to the first engine 2*a*, and then after a delay, output the second throttle signal to the second engine 2*b* at the start of the leftward swaying mode.

The watercraft operating controller 30 may output the second throttle signal to the second engine 2*b*, and then after a delay, output the first throttle signal to the first engine 2*a* at the start of the clockwise bow turning mode. The watercraft operating controller 30 may output the first throttle signal to the first engine 2*a*, and then after a delay, output the second throttle signal to the second engine 2*b* at the start of the counterclockwise bow turning mode.

In a similar manner to the preferred embodiments described above, in the throttle delay control as well, the watercraft operating controller 30 may change the delay time depending on the magnitude of the requested forward moving directional thrust. Additionally, in a similar manner to the preferred embodiments described above, the watercraft operating controller 30 may not execute the throttle delay control depending on how the joystick 26 had been operated before being operated to execute the swaying mode or the bow turning mode.

One or more predetermined modes, in which the shift delay control or the throttle delay control is executed, are not limited to the swaying mode and the bow turning mode and may be other than this combination of modes. For example, the shift delay control or the throttle delay control may be executed only in the swaying mode. The shift delay control or the throttle delay control may be executed only in the bow turning mode. Alternatively, the shift delay control or the throttle delay control may be executed in a mode other than the swaying mode and the bow turning mode. For example, the shift delay control or the throttle delay control may be executed in an automated watercraft operating mode to control the marine propulsion devices to move the watercraft along a predetermined trajectory.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A system for controlling a watercraft, the system comprising:

a first marine propulsion device including a first shift mechanism switchable to a forward moving state and a rearward moving state, the first marine propulsion device being rotatable about a first steering shaft;

a first steering actuator to rotate the first marine propulsion device about the first steering shaft;

a second marine propulsion device including a second shift mechanism switchable to the forward moving state and the rearward moving state, the second marine propulsion device being rotatable about a second steering shaft;

a second steering actuator to rotate the second marine propulsion device about the second steering shaft; and a controller configured or programmed to:

control the first marine propulsion device, the first steering actuator, the second marine propulsion device, and the second steering actuator in a swaying mode to cause translational movement of the watercraft in a sideways direction;

set either of the first and second shift mechanisms to the forward moving state and set the other of the first and second shift mechanisms to the rearward moving state, while controlling a rudder angle of the first marine propulsion device and a rudder angle of the second marine propulsion device such that a net thrust of a thrust generated by the first marine propulsion device and a thrust generated by the second marine propulsion device is oriented in the sideways direction in the swaying mode; and when setting the first shift mechanism to the forward moving state and setting the second shift mechanism to the rearward moving state at a start of the swaying mode, switch the second shift mechanism to the rearward moving state and then switch the first shift mechanism to the forward moving state after a delay.

2. The system according to claim 1, wherein the controller is further configured or programmed to:

when setting the first shift mechanism to the forward moving state and setting the second shift mechanism to the rearward moving state at the start of the swaying mode, switch the second shift mechanism to the rearward moving state and then switch the first shift mechanism to the forward moving state after a predetermined delay time.

3. The system according to claim 2, wherein the controller is further configured or programmed to:

determine a thrust requested to be generated by the first marine propulsion device; and change the predetermined delay time depending on a magnitude of the thrust requested.

4. The system according to claim 1, further comprising:

an operator operable to select one of a plurality of operating modes of the watercraft including the swaying mode and a fore surging mode; wherein the controller is further configured or programmed to:

when the one of the plurality of operating modes selected by the operator is changed from the fore surging mode to the swaying mode, switch the first shift mechanism to the forward moving state without delay at the start of the swaying mode.

5. A system for controlling a watercraft, the system comprising:

a first marine propulsion device including a first shift mechanism switchable to a forward moving state and a rearward moving state;

a second marine propulsion device including a second shift mechanism switchable to the forward moving state and the rearward moving state; and a controller configured or programmed to:

control the first marine propulsion device and the second marine propulsion device in a bow turning mode to cause the watercraft to perform a bow turning motion;

cause the watercraft to perform the bow turning motion by setting either of the first and second shift mechanisms to the forward moving state and setting the other of the first and second shift mechanisms to the rearward moving state in the bow turning mode; and when setting the first shift mechanism to the forward moving state and setting the second shift mechanism to the rearward moving state at a start of the bow turning mode, switch the second shift mechanism to the rearward moving state and then switch the first shift mechanism to the forward moving state after a delay.

6. The system according to claim 5, wherein the controller is further configured or programmed to:

when setting the first shift mechanism to the forward moving state and setting the second shift mechanism to the rearward moving state at the start of the bow turning mode, switch the second shift mechanism to the rearward moving state and then switch the first shift mechanism to the forward moving state after a predetermined delay time.

7. The system according to claim 6, wherein the controller is further configured or programmed to:

determine a thrust requested to be generated by the first marine propulsion device; and change the predetermined delay time depending on a magnitude of the thrust requested.

8. The system according to claim 5, further comprising:

an operator operable to select one of a plurality of operating modes of the watercraft including the bow turning mode and a fore surging mode; wherein the controller is further configured or programmed to:

when the one of the plurality of operating modes selected by the operator is changed from the fore surging mode to the bow turning mode, switch the first shift mechanism to the forward moving state without delay at the start of the bow turning mode.

9. A system for controlling a watercraft, the system comprising:

a first marine propulsion device including a first shift mechanism switchable to a forward moving state and a rearward moving state;

a second marine propulsion device including a second shift mechanism switchable to the forward moving state and the rearward moving state; and a controller configured or programmed to:

control the first marine propulsion device and the second marine propulsion device in a predetermined operating mode;

cause the watercraft to move in the predetermined operating mode by setting either of the first and second shift mechanisms to the forward moving state and setting the other of the first and second shift mechanisms to the rearward moving state; and when setting the first shift mechanism to the forward moving state and setting the second shift mechanism to the rearward moving state at a start of the predetermined operating mode, switch the second shift mechanism to the rearward moving state and then switch the first shift mechanism to the forward moving state after a delay.

10. The system according to claim 9, wherein the controller is further configured or programmed to:

when setting the first shift mechanism to the forward moving state and setting the second shift mechanism to the rearward moving state at the start of the predetermined operating mode, switch the second shift mechanism to the rearward moving state and then switch the first shift mechanism to the forward moving state after a predetermined delay time.

11. The system according to claim 10, wherein the controller is further configured or programmed to:

determine a thrust requested to be generated by the first marine propulsion device; and change the predetermined delay time depending on a magnitude of the thrust requested.

12. The system according to claim 9, further comprising:

an operator operable to select either of the predetermined operating mode and a fore surging mode; wherein the controller is further configured or programmed to:

when the fore surging mode is changed by the operator to the predetermined operating mode, switch the first shift mechanism to the forward moving state without delay at the start of the predetermined operating mode.

13. A system for controlling a watercraft, the system comprising:

a first marine propulsion device including a first engine and a first shift mechanism, the first engine being controlled in accordance with a first throttle command, and the first shift mechanism being switchable to a forward moving state and a rearward moving state;

a second marine propulsion device including a second engine and a second shift mechanism, the second engine being controlled in accordance with a second throttle command, and the second shift mechanism being switchable to the forward moving state and the rearward moving state; and a controller configured or programmed to:

control the first marine propulsion device and the second marine propulsion device in a predetermined operating mode;

cause the watercraft to move in the predetermined operating mode by setting either of the first and second shift mechanisms to the forward moving state and setting the other of the first and second shift mechanisms to the rearward moving state; and when setting the first shift mechanism to the forward moving state and setting the second shift mechanism to the rearward moving state at a start of the predetermined operating mode, output the second throttle command to the second engine and then output the first throttle command to the first engine after a delay.

14. The system according to claim 13, wherein the controller is further configured or programmed to:

when setting the first shift mechanism to the forward moving state and setting the second shift mechanism to the rearward moving state at the start of the predetermined operating mode, output the second throttle command to the second engine and then output the first throttle command to the first engine after a predetermined delay time.

15. The system according to claim 14, wherein the controller is further configured or programmed to:

determine a thrust requested to be generated by the first marine propulsion device; and change the predetermined delay time depending on a magnitude of the thrust requested.

16. The system according to claim 13, further comprising:

an operator operable to select either of the predetermined operating mode and a fore surging mode; wherein the controller is further configured or programmed to:

when the fore surging mode is changed by the operator to the predetermined operating mode, output the first throttle command to the first engine without delay at the start of the predetermined operating mode.

* * * * *